US006714106B1

(12) United States Patent
Czarnecki et al.

(10) Patent No.: US 6,714,106 B1
(45) Date of Patent: Mar. 30, 2004

(54) SWITCH HAVING INTEGRAL REMOTE ACTUATING DEVICE

(75) Inventors: Neil A. Czarnecki, Racine, WI (US); Francis W. Camps, Kewaskum, WI (US); Ray C. Wojtak, Waterford, WI (US)

(73) Assignee: Reliance Controls Corporation, Racine, WI (US)

( * ) Notice: Subject to any disclaimer, the term of this patent is extended or adjusted under 35 U.S.C. 154(b) by 151 days.

(21) Appl. No.: 10/037,368

(22) Filed: Jan. 4, 2002

(51) Int. Cl.[7] ..... H01H 45/00; H01H 3/00

(52) U.S. Cl. ..... 335/1; 335/68; 335/186; 335/189; 200/331

(58) Field of Search ..... 335/68, 185, 186, 335/189, 190, 191, 202, 1; 200/329–332, 332.1

(56) References Cited

U.S. PATENT DOCUMENTS 1,538,950 A 5/1925 Price
3,832,658 A 8/1974 Hayden
4,376,896 A 3/1983 Takeda et al.
4,393,360 A 7/1983 Arakawa et al.
4,831,349 A 5/1989 Hirose et al.
5,072,328 A 12/1991 Dvorak et al.
5,113,308 A 5/1992 Takeda
5,680,082 A 10/1997 Stocklin
5,740,003 A 4/1998 Seymour et al.
5,838,219 A * 11/1998 Du et al. ..... 335/14

* cited by examiner

*Primary Examiner*—Ramon M. Barrera
(74) *Attorney, Agent, or Firm*—Andrus, Sceales, Starke & Sawall, LLP

(57) ABSTRACT

A manually operable switch has an opening handle pivotally mounted on a housing for moving a set of contacts in the housing from one position to another. A force generating arrangement is mounted outside the switch housing, and a force translation system extends between the housing and the force generating arrangement. The force translation system has a first end structure movable into and out of contact with the operating handle, and a second end structure disposed for movement in the force generating arrangement.

11 Claims, 4 Drawing Sheets

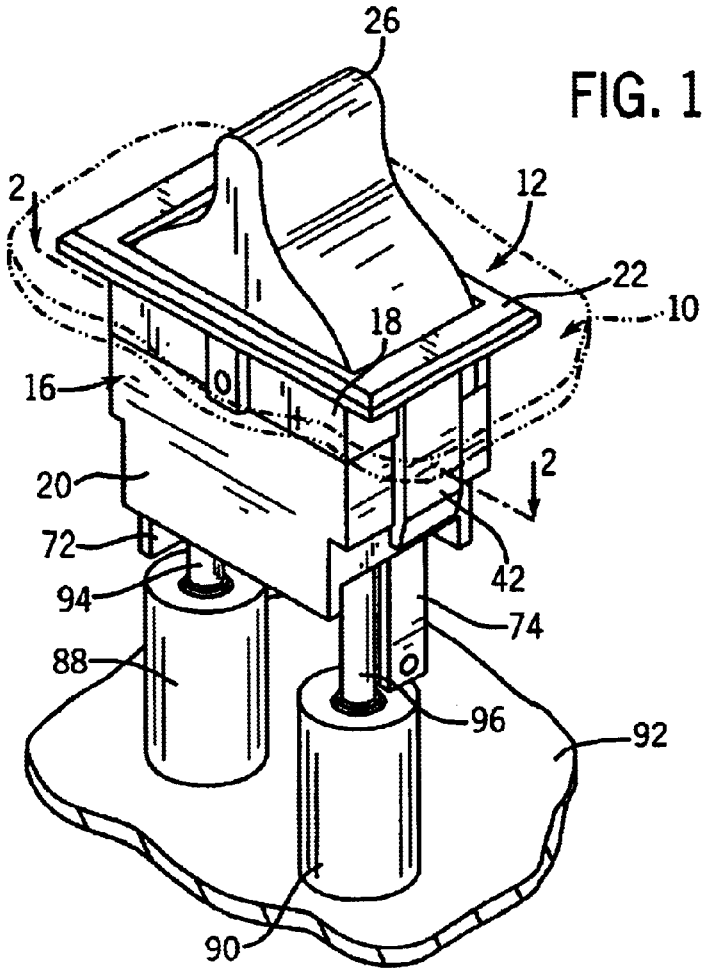
FIG. 1
FIG. 2
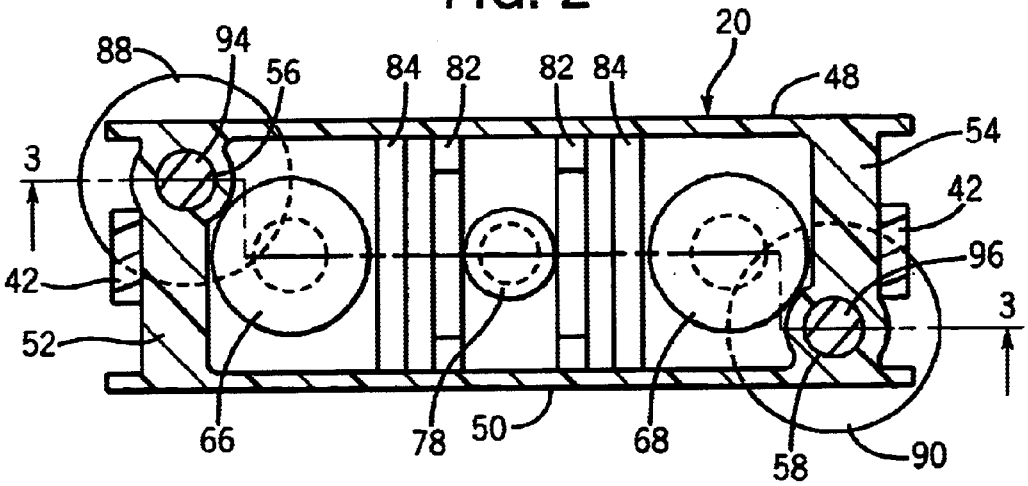

SWITCH HAVING INTEGRAL REMOTE ACTUATING DEVICE

FIELD OF THE INVENTION

This switch broadly relates to an electrical switch having a control arrangement for adjusting the position of a pair of contacts and, more particularly, pertains to a switch which can be easily modified to allow the switch to be remotely actuated while still permitting the switch to be manually operated.

BACKGROUND OF THE INVENTION

Various switching devices are known that include a solenoid or other movable device for adjusting the position of a pair of contacts. One such device is disclosed in U.S. Pat. No. 3,852,658 issued Aug. 27, 1974 to Hayden. In this patent, a manually operated switch has a housing in which a pair of solenoids are permanently mounted. Each of the solenoids has a plunger coupled to a common movable armature. The movement of the armature caused by actuation and deactuation of the solenoids enables contacts on a circuit board attached to the solenoids to be opened and closed.

Hayden is representative of several electrical switch component configurations wherein the solenoids or other remote actuators are fixed within the electric switching component housing so that they cannot be modified, replaced, or reengineered. In the event of a problem with such a switch, a common remedy is to replace the entire switch which may not be the most efficient method of resolving the problem. For example, even though the mechanical aspects of the switch may be in good working order, failure of one or more of the solenoids or their internally mounted circuit or control arrangement causes installation of an entirely new switch which may be unnecessarily expensive for the switch user.

Accordingly, it is desirable to provide a manually operable switch design so that it can be remotely actuated from outside the switch housing. It is also desirable to provide a manually operated switch with a remote actuation feature which can be added to the switch at any time. It is further desirable that the remote actuation be provided by various force generating devices not necessarily limited to a solenoid.

SUMMARY OF THE INVENTION

It is a general object of the present invention to provide a manually operated switch which may be conveniently and economically converted to a remotely actuated device.

It is also an object of the present invention to provide a switch housing designed to transfer motion to a switch handle from outside the switch housing.

It is a further object of the present invention to provide a switch housing which is simply modified to accept a remote actuation device without disassembly of the switch housing.

It is an additional object of the present invention to provide a manually operable switch for selectively accepting a pair of plungers in order to transfer movement from a force generating device to the handle of the switch.

It is another object of the present invention to provide a manually operated switch having an optional remote actuation feature which may be installed without special tools or fasteners.

In one aspect of the invention, a manually operable switch has an operating handle movably mounted on a housing for moving a set of contacts in the housing from one position to another. The invention is improved by a force generating arrangement mounted outside the switch housing, and a force translation system extending between the housing and the force generating arrangement. The force translation system has a first end structure movable into and out of contact with the operating handle and a second end structure disposed for movement in the force generating arrangement. The force generating arrangement is selected from the group consisting of an electromagnetic solenoid, a wax motor, a linear actuator, a shape memory effect (SME) actuator, a servo motor, a stepper motor, a pneumatic cylinder, a hydraulic cylinder and a piezoceramic actuator. The preferred embodiment has a forced translation system comprised of a pair of elongated plungers. A control structure is operably connected to the force generating device outside the housing.

In another aspect of the invention, a switch includes a housing having wall structure formed with at least one throughbore, and an operating handle pivotally mounted to the wall structure for manually moving a set of contracts in the housing from one position to another. A force generating device is disposed externally of the housing. At least one plunger is movably mounted in the throughbore and has one end engageable with the operating handle and an opposite end engageable with the force generating device. A housing has a lower section removably attached to an upper section. A wall structure of the housing lower section has a length and a height, the throughbore being formed along substantially the entire height of the wall structure of the housing lower section. The housing is suspendedly mounted in a support panel.

In yet another aspect of the invention, a manually operable switch is provided which is remotely actuated. The switch includes a housing mounted in a support panel and having wall structure formed of a pair of spaced apart throughbores, and an operating handle with opposed ends pivotally mounted to the wall structure for moving a set of contacts from one position to another, the opposed ends of the operating handle being aligned with the throughbores. A pair of force generating devices is mounted exteriorly of the housing on a support structure. A pair of elongated plungers is disposed for reciprocal movement in the throughbores, each plunger having a first end movable into and out of contact with one end of the operating handle and a second end disposed for movement in one of the force generating devices. A control structure is disposed outside the housing and is operably connected to the force generating devices to control actuation and de-actuation thereof so as to move the plunger in a manner which will remotely pivot the operating handle. The force generating devices are located beneath the housing. The control structure is comprised of a controller, a receiver and a transmitter, all interconnected together.

The invention also contemplates a method of converting a manually operable switch to a remotely actuated switch, the switch having an operating handle movably mounted on a housing for moving a set of contacts from one position to another. The method includes the steps of forming a housing with a pair of throughbores in alignment with opposite ends of the operating handle; providing a pair of force generating devices mounted outside the housing, each of the force generating devices having a plunger movably mounted therein with a first end receivable in one of the throughbores and movable into and out of engagement with an end of the operating handle, and a second end disposed for movement in the force generating device; inserting the plungers into the throughbores in the housing; and selectively actuating the force generating devices so as to effect remote movement of the operating handle.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is a perspective view of a switch embodying an optional remote actuating arrangement of the invention;

FIG. 2 is an enlarged sectional view taken on line 2—2 of FIG. 1;

DETAILED DESCRIPTION OF THE INVENTION

Figure 3:
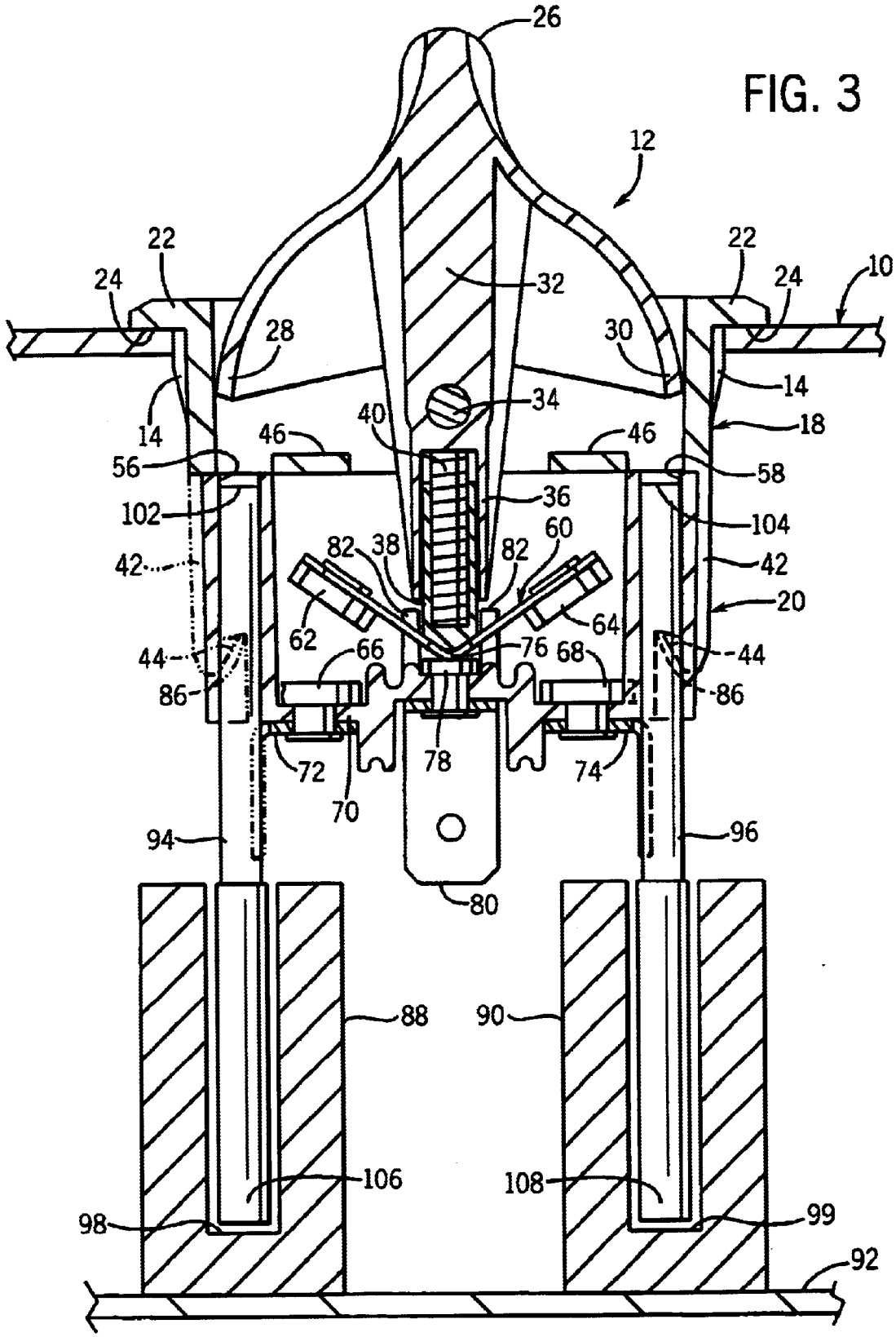
FIG. 3 is an enlarged sectional view taken on line 3—3 of FIG. 2.

Referring now to the drawings, FIG. 1 illustrates a planar support panel 10 formed with a suitable opening for seating a manually operable switch 12 having stabilizing protrusions 14 as seen in FIG. 3 and described in assignee's pending U.S. patent application Ser. No. 10/037,387 filed Jan. 4, 2002, now U.S. Pat. No. 6,613,995, which is hereby incorporated by reference. Switch 12, as will be discussed below, is provided with a remote actuation feature which is extremely useful in situations where the switch 12 is inaccessible or otherwise unable to be manually operated.

Switch 12 is preferably a single pole, double throw (SPDT) paddle switch having a generally rectangular housing 16 with a periphery which is slightly smaller than the support panel opening. In the preferred embodiment housing 16 has an upper section 18 removably attached to a lower section 20.

Upper section 18 has four corners and a top facing 22 which has flanges 24 extending outwardly therefrom for overlying engagement with the support panel 10 to prevent the switch 12 from sliding through the panel opening. As seen in FIG. 3, the upper section 18 is open along its top to receive a movable operating handle 26 having opposed ends 28, 30 and a central spine 32 which is pivotally mounted at 34 to opposite sides of the upper section 18. The spine 32 terminates in a pair of cylindrical receivers 36 (one being seen in the drawings) for slidably accommodating a pair of fingers 38 (one being shown in the drawings). Each of the fingers 38 is biased outwardly by a compression spring 40 for engagement with a movable contact structure in the lower section 20. Opposite ends of upper section 18 are provided with downwardly depending resilient legs 42 having hooked bottoms 44 adapted to snap into ends of lower section 20. The bottom of upper section 18 has a pair of transverse walls 46, one being between each leg 42 and the receivers 36 to add reinforcement to the upper section 18.

Lower section 20, as shown in FIGS. 2 and 3, also has four corners defined by the intersection of opposed side walls 48, 50 and opposed end walls 52, 54. As will be appreciated hereafter, the end walls 52, 54 are formed thicker than the side walls 48, 50 so that a pair of throughbores 56, 58 extend throughout the height of the lower section 20. One of the throughbores 56 is located at a rear corner on one side of the lower section 20, and the other of the throughbores 58 is formed at a front corner on the other side of the lower section 20. These throughbores 56, 58 are utilized to facilitate a simple conversion of the manually operable switch 12 to a remotely actuated switch.

Lower section 20 has an open top for receiving a V-shaped contact plate 16 which is rocked back and forth by motion of the pivoting operating handle 26. The contact plate 60 has a pair of movable contacts 62, 64 at opposite ends which are selectively engageable with fixed contacts 66, 68 mounted at opposite ends on an inside bottom wall 70 of the lower section 20. Each fixed contact 66, 68 is provided with a conducting terminal bracket 72, 74 which depends from the bottom wall 70. Contact plate 60 has an apex 76 with a top surface engaged by the spring biased fingers 38, and a bottom surface which pivots on top of a fixed grounding contact 78. Grounding contact 78 is connected to a grounding terminal bracket. 80 which depends from the bottom wall 70 on one side of the lower section 20 between the conducting terminal brackets 72, 74. The inside bottom wall 70 also includes two pairs of transverse ridges 82, 84 for strengthening bottom wall 70 and maintaining the separation of the contacts 66, 68. The inner pair of ridges 82 extends partially upwardly along the inside surfaces of the side walls 48, 50 to provide a guiding channel into which opposed projections on the apex 76 of V-shaped contact plate 60 are disposed. Opposite end walls 52, 54 of the lower section 20 include notches 86 into which the hooked bottoms 44 of the upper section legs 42 are retained when the upper section 18 is pushed downwardly into the lower section 20 to complete the switch 12.

Figure 4:
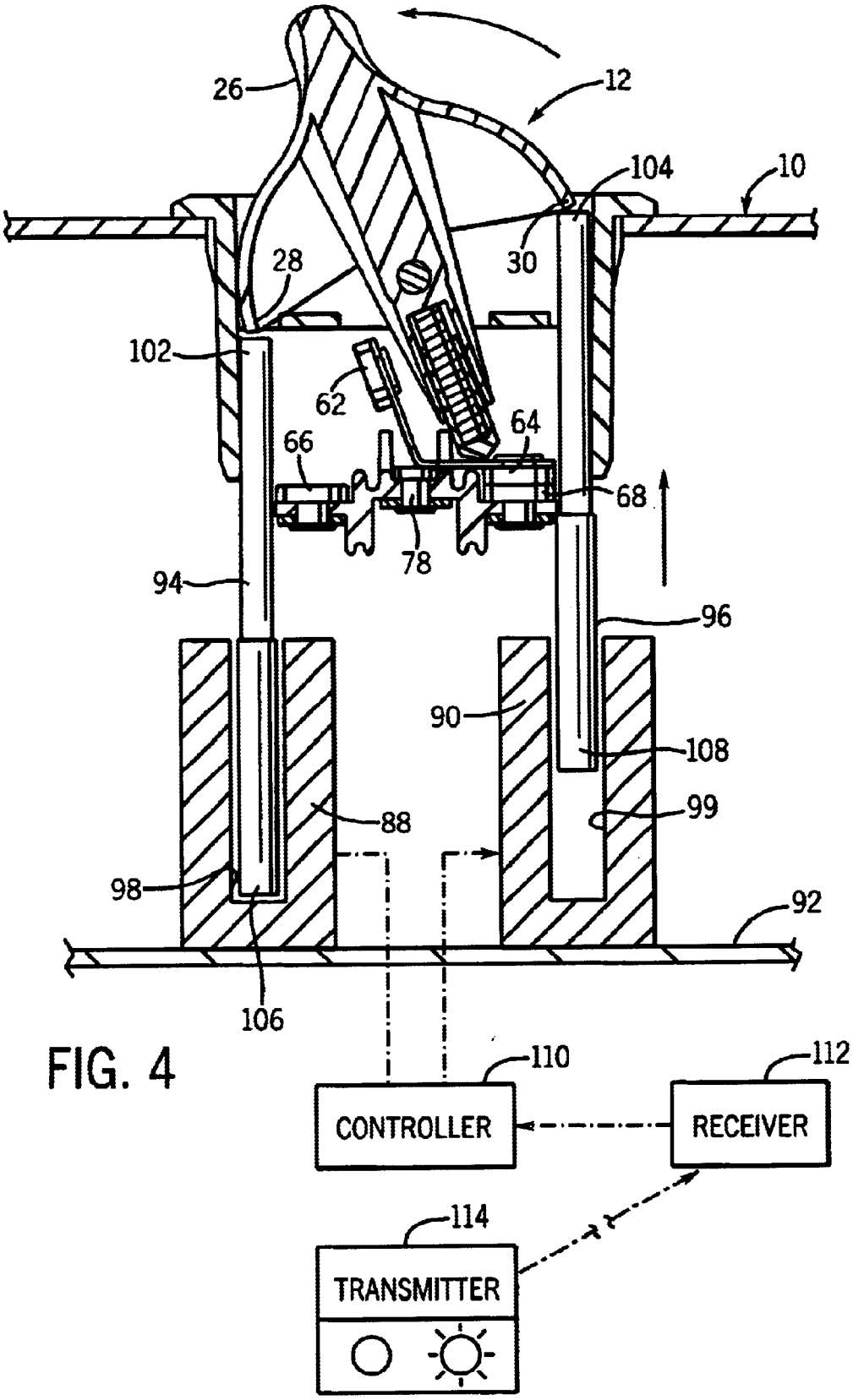
FIG. 4 is a view similar to FIG. 3 showing a control system for remotely moving the switch to one operating position.
Figure 5:
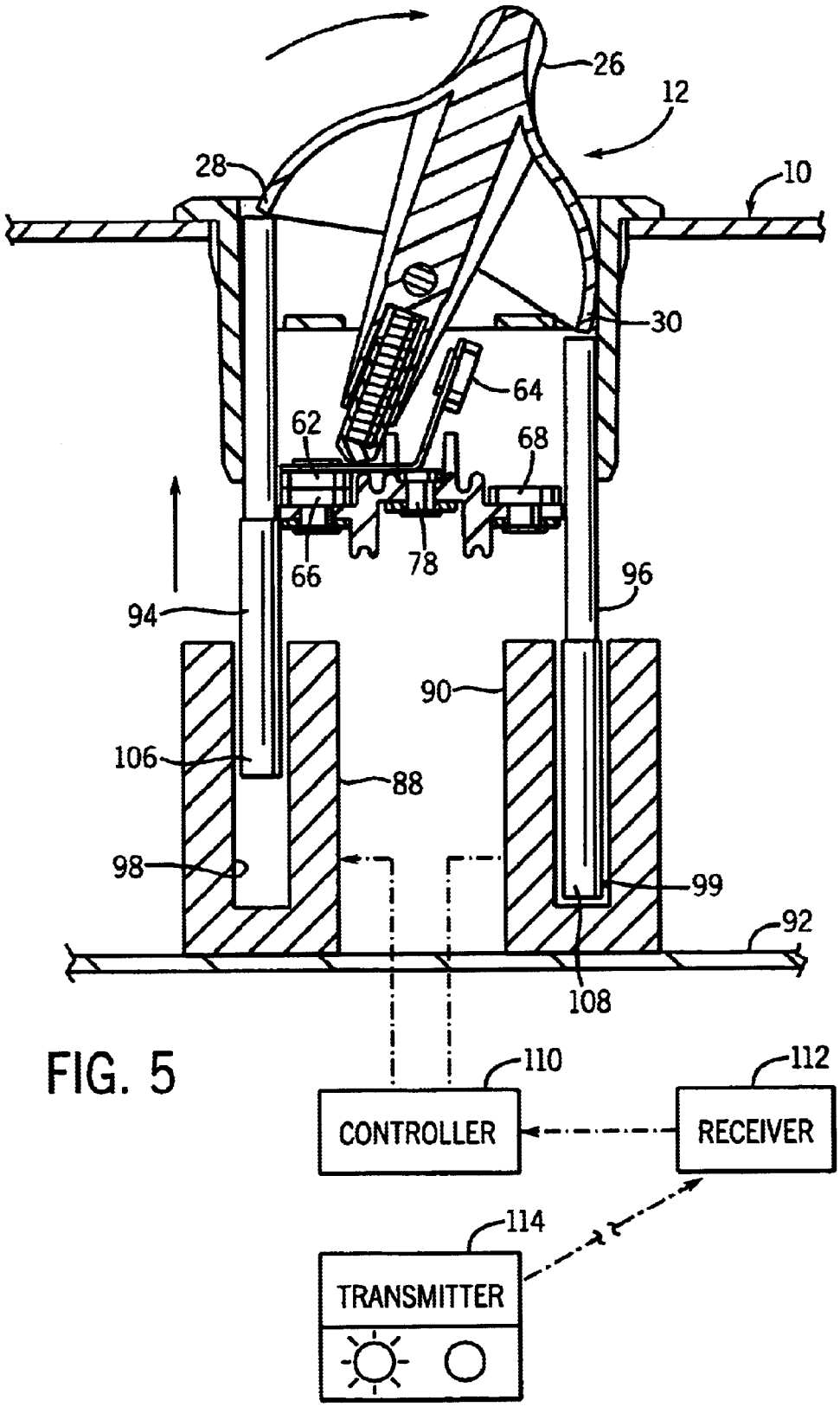
FIG. 5 is a view similar to FIG. 4 showing a control system for remotely moving the switch to an opposite operating position.

In FIGS. 1 and 3, the assembled and seated, manually operable switch 12 is shown in a neutral position in which the operating handle 26 is centered so that the spine 32 is vertical and both movable contacts 62, 64 are spaced apart from their mating fixed contacts 66, 68. In FIG. 4, the operating handle 26 is manually moved to the left in the direction of the upper arrow so as to flip the contact plate 60 causing contacts 64, 68 to engage and define, for example, an ON position. FIG. 5 shows the operating handle 26 manually moved to the right as indicated by the upper arrow so as to move the switch 12, for example, to an OFF position.

In accordance with the present invention, the manually operable switch 12 may be conveniently and economically converted as an option to a remotely actuated switch. That is, switch 12 can be modified to include a force generating arrangement mounted outside the switch housing, and a force translation system extending between the housing 16 and force generating arrangement. The force translation system has a first end structure movable into and out of contact with the operating handle 26, and a second end structure disposed for movement in the force generating arrangement. Control structure is operably connected to the force generating arrangement outside the housing 16 to control actuation and deactuation thereof.

Force generating arrangement preferably takes the form of a pair of spaced is apart, electromagnetic linear solenoids 88, 90 which are fixed or removably mounted on a support structure 92 exteriorly of and beneath the switch housing 16. At this point, it should be understood that the force generating arrangement may also suitably take the form of an electromagnetic rotary solenoid, a wax motor, a linear actuator, a shape memory effect (SME) actuator, a servo motor, a stepper motor, a pneumatic or hydraulic cylinder or a piezoceranic actuator.

Force translation system is defined preferably by a pair of elongated plungers 94, 96, each being slidably received for linear up and down movement in a respective cavity 98, 99 of a respective solenoid 88, 90. Solenoids 88, 90 and their plungers 94, 96 are strategically placed on support structure 92 at diagonally opposite corners beneath housing 16 such that the plungers 94, 96 are in alignment with the throughbores 56, 58 formed in the corner wall structure of the switch housing 16. Each plunger 94, 96 has a respective upper end 102, 104 which is movable into and out of engagement with a respective opposed end 28, 30 on the operating handle 26, and a respective lower end 106, 108 movable up and down in the respective solenoid cavity 98, 99.

Referring now to FIGS. 4 and 5, control structure is preferably comprised of a controller 110 operably connected to the solenoids 88, 90, a receiver 112 operably connected to the controller 110 for sending a control signal thereto, and a transmitter 114 operably connected to the receiver 112 to transmit the control signal causing the switch 12 to remotely rather than manually assume an ON or OFF position.

In FIG. 4, the control actuates only solenoid 90 so that plunger 96 will move in the direction of the lower arrow upwardly and contact the right-hand end 30 of operating handle 26 so that handle will pivot to the left. As described in the manual operation, this motion causes engagement between contacts 64, 68 so as to provide a first or ON position. When it is desired to move the switch 12 to a second or OFF position, solenoid 90 is deactuated so plunger 94 will move upwardly as shown in FIG. 5 by the lower arrow and abut the opposite end 28 of the operating handle 26. This will pivot the operating handle 26 in the opposite direction as FIG. 4 so that engagement between contacts 62, 66 is made. If necessary, both plungers 94, 96 can be simultaneously controlled by the solenoids 88, 90 to place the operating handle 26 in a neutral position of FIG. 3.

It must be appreciated that in order to convert the manually operable switch 12 to a remote actuated switch, one simply slides the upper ends 102, 104 of the plungers 94, 96 into the throughbores, 56, 58 from the bottom of the housing 16. As seen in FIG. 3, the plungers 94, 96 have a length such that their upper ends 102, 104 extend up to the top of lower section 20 of housing 16 when the lower ends 106, 108 of the plungers 94, 96 are completely seated in the solenoids 88, 90. There is no need to resort to any insulation tools or fasteners.

It should also be understood that the remote actuated arrangement can be added to or removed from the manually operable switch 12 at any time within a matter of seconds. Likewise, it should be further understood that the force generating arrangement may take many alternative forms other than solenoids 88, 90 as noted above.

One of the major advantages of the remote actuated switch is that solenoids 88, 90 and the plungers 94, 96 are supported exteriorly of the switch housing 16. This allows an easier and more convenient replacement or reengineering of a switch 12. The snap assembly of the switch housings 18, 20 contributes to the efficiency of the switch repair and/or inspection. In prior art remote actuated switches having solenoids permanently fixed inside the housing, it is often the case that entire switches are discarded in lieu of entire new switches which adds to the operating cost to the user. It is also important to note that the solenoids 88, 90 or other actuators can be remotely mounted to their support structure 92 so that they can be easily replaced without having to disassemble the switch 12.

While the switch 12 described above shows the preferred use of two solenoids and two plungers, it is within the purview of the invention that a user might design a switch having a spring biased operating handle and a single plunger and solenoid combination. In such design, the operating handle could be biased to one position and the plunger and solenoid could be used to temporarily move the switch to another position.

While the invention has been described with reference to a preferred embodiment, those skilled in the art will appreciate that certain substitutions, alterations and omissions be made without departing from the spirit thereof. Accordingly, the foregoing description is meant to be exemplary only, and should not be deemed limitative on the scope of the invention as set forth in the following claims.

We claim:

1. In a manually operable switch having an operating handle movably mounted on a housing for moving a set of contacts in the housing between off and on positions, the improvement comprising:

a force generating arrangement mounted outside the switch housing; and a force translation system having a longitudinal axis extending between the housing and the force generating arrangement and having a first end structure linearly slidable along the longitudinal axis into and out of contact with the operating handle and a second end structure disposed for linear slidable movement along the longitudinal axis and inside the force generating arrangement.

2. The improvement of claim 1, wherein the force translation system is comprised of a pair of elongated plungers.

3. The improvement of claim 1, wherein a control structure is operably connected to the force generating device outside the housing.

4. A switch comprising:

a housing having wall structure forded with at least one throughbore, and an operating handle pivotally mounted to the wall structure for manually moving a set of contacts in the housing from one position to another;

a force generating device disposed externally of the housing; and at least one plunger movably mounted in the throughbore and having one end engageable with the operating handle and an opposite end engageable with the force generating device.

5. The switch of claim 4, wherein the housing has a lower section removably attached to an upper section.

6. The switch in claim 5, wherein the wall structure of the housing lower section has a length and a height, the throughbore being formed along substantially the entire height of the wall structure of the housing lower section.

7. The switch of claim 4, wherein the housing is suspendedly mounted in a support panel.

8. A manually operable switch which may be removably actuated comprising:

a housing mounted in a support panel and having wall structure formed with a pair of spaced apart throughbores, and an operating handle with opposed ends pivotally mounted to the wall structure for moving a set of contacts from one portion to another, the opposed ends of the operating handle being aligned with the throughbores;

a pair of force generating devices mounted exteriorly of the housing on a support structure;

a pair of elongated plungers disposed for reciprocal movement in the throughbores, each plunger having a first end movable into and out of contact with one end of the operating handle, and a second end disposed for movement in one of the force generating devices; and a control structure disposed outside the housing and operably connected to the force generating devices to control actuation and deactuation thereof so as to move the plungers in a manner which will remotely pivot the operating handle.

9. The switch of claim 8, wherein the force generating devices are located beneath the housing.

10. The switch of claim 8, wherein the control structure is comprised of a controller, a receiver and a transmitter, all interconnected together.

11. A method of converting a manually operable switch to a remotely actuated switch, the switch having an operating handle movably mounted in a housing for moving a set of contracts from one position to another, the method comprising the steps of:

forming the housing with a pair of throughbores, in alignment with opposite ends of each operating handle;

providing a pair of force generating devices mounted outside the housing, each of the force generating devices having a plunger movably mounted therein with a first end receivable in one of the throughbores and movable into and out of engagement with an end of the operating handle, and a second end disposed for movement in the force generating device;

inserting the plunger into the throughbores in the housing; and selectively actuating the force generating device so as to effect remote movement of the operating handle.

* * * * *